US010320042B2

(12) United States Patent
Jensen

(10) Patent No.: US 10,320,042 B2
(45) **Date of Patent: *Jun. 11, 2019**

(54) WAVEGUIDE DEVICE WITH SIDEWALL FEATURES

(71) Applicant: ViaSat, Inc., Carlsbad, CA (US)

(72) Inventor: Anders Jensen, Johns Creek, GA (US)

(73) Assignee: Viasat, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/111,534

(22) Filed: Aug. 24, 2018

(65) Prior Publication Data

US 2018/0366801 A1 Dec. 20, 2018

Related U.S. Application Data

(63) Continuation of application No. 14/940,333, filed on Nov. 13, 2015, now Pat. No. 10,096,876.

(51) Int. Cl.

| | |
|---|---|
| ***H01P 1/161*** | (2006.01) |
| ***H01P 3/123*** | (2006.01) |
| ***H01Q 15/24*** | (2006.01) |
| ***H01P 1/17*** | (2006.01) |
| ***H01Q 21/06*** | (2006.01) |
| *H01Q 19/13* | (2006.01) |
| *H01Q 21/24* | (2006.01) |

(52) U.S. Cl.

CPC ..... *H01P 1/161* (2013.01); *H01P 1/173* (2013.01); *H01P 3/123* (2013.01); *H01Q 15/246* (2013.01); *H01Q 21/061* (2013.01); *H01Q 19/132* (2013.01); *H01Q 21/24* (2013.01)

(58) Field of Classification Search

CPC .. H01P 1/16; H01P 1/161; H01P 1/165; H01P 1/172; H01P 1/173; H01P 3/123; H01Q 15/246; H01Q 19/132; H01Q 21/061; H01Q 21/24

USPC ..... 333/21 A, 138, 157, 160

See application file for complete search history.

(56) References Cited

U.S. PATENT DOCUMENTS

| | | | |
|---|---|---|---|
| 4,122,406 | A | 10/1978 | Salzberg |
| 4,126,835 | A | 11/1978 | Gould |
| 4,356,459 | A | 10/1982 | Gould et al. |
| 4,492,938 | A | 1/1985 | Young |

(Continued)

FOREIGN PATENT DOCUMENTS

| | | | |
|---|---|---|---|
| CN | 203225337 | U | 10/2013 |
| DE | 4437595 | A1 | 5/1995 |

(Continued)

OTHER PUBLICATIONS

Parekh, Non-Final Office Action dated Nov. 24, 2017, "Waveguide Device with Septum Features", U.S. Appl. No. 14/948,179; 10 pgs.

(Continued)

*Primary Examiner* — Rakesh B Patel
*Assistant Examiner* — Jorge L Salazar, Jr.
(74) *Attorney, Agent, or Firm* — Holland & Hart LLP

(57) ABSTRACT

Methods, systems, and devices are described that include one or more sidewall features to improve performance of a waveguide device. In particular, the sidewall features may be utilized within a polarizer section of a polarizer device such as a septum polarizers. The sidewall feature(s) may include recesses and/or protrusions. When a plurality of sidewall features are employed, the size, shape, spacing and kind (e.g., recess or protrusion) may vary according to a particular design.

35 Claims, 7 Drawing Sheets

(56) References Cited

U.S. PATENT DOCUMENTS

| | | | |
|---|---|---|---|
| 5,061,037 | A | 10/1991 | Wong et al. |
| 5,305,001 | A | 4/1994 | Wong et al. |
| 6,507,323 | B1 | 1/2003 | West |
| 6,522,215 | B2 | 2/2003 | Enokuma |
| 6,661,390 | B2 | 12/2003 | Gau et al. |
| 6,861,997 | B2 | 3/2005 | Mahon |
| 7,132,907 | B2 | 11/2006 | Chambelin et al. |
| 8,077,103 | B1 | 12/2011 | Acosta et al. |
| 8,354,969 | B2 | 1/2013 | Lin et al. |
| 8,525,616 | B1 | 9/2013 | Shaw et al. |
| 9,000,861 | B2 | 4/2015 | Ado et al. |
| 2002/0171596 | A1 | 11/2002 | Em et al. |
| 2014/0254976 | A1 | 9/2014 | Thomson et al. |

FOREIGN PATENT DOCUMENTS

| | | | |
|---|---|---|---|
| JP | 2007329741 | A | 12/2007 |
| KR | 101228014 | B1 | 2/2013 |
| WO | WO 2014108203 | A1 | 7/2014 |

OTHER PUBLICATIONS

Czech Technical University in Prague, "Advanced Design of Reflector Based Antennas", dated Jun. 2011, Czech Technical University in Prague, 19 pages.

Chang, T. H., *Dual-function Circular Polarization Converter for Microwave/Plasma Processing Systems*, Review of Scientific Instruments, vol. 70, No. 2, Feb. 1999, 5 pages.

Chou, et al., "Numerical Investigation on the Performance of a Septum Polarizer by Inserting Additional Stubs for its Applications in the CP Horn Antennas", Microwave and Optical Technology Letters, vol. 51, No. 1, Jan. 2009, pp. 269-273.

Galuscak, et al., *Compact Circular/Linear Polarization Dual-Band Prime-Focus Feed for Space Communication*, International Journal of Antennas and Propagation vol. 2012, Article ID 860951, 5 pgs.

Wade, *Septum Polarizers and Feeds*, W1GHZ Copyright 2003, 20 pgs.

Ihmels, et al. "Field Theory Design of a Currugated Septum OMT", Jun. 1993, Microwave Symposium Digest, pp. 909-912.

Elliott, "Two-Mode Waveguide for Equal Mode Velocities", IEEE Transactions on Microwave Theory and Techniques, vol. MTT-16, No. 5, May 1968, 5 pgs.

WAVEGUIDE DEVICE WITH SIDEWALL FEATURES

CROSS REFERENCES

The present Application for Patent is a continuation of U.S. patent application Ser. No. 14/940,333 by JENSEN, entitled "WAVEGUIDE DEVICE WITH SIDEWALL FEATURES," filed Nov. 13, 2015, assigned to the assignee hereof, and expressly incorporated herein.

BACKGROUND

The present disclosure, for example, relates to wireless communications systems, and more particularly to waveguide devices that may be employed in such systems.

By way of example, a waveguide device may be used for uni-directional (transmit or receive) or bi-directional (transmit and receive) of polarized waves. The waveguide device may include a polarizer that converts between polarized (e.g., linearly polarized, circularly polarized, etc.) waves used for transmission and/or reception via a common waveguide and signals associated with basis polarizations of the polarizer in a divided waveguide section. The polarizer may be a passive polarization transducer. A septum polarizer is one such passive polarization transducer that can operate in a bi-directional manner. A septum polarizer includes a septum which forms a boundary between first and second divided waveguides associated with the basis polarizations. Septum polarizers may provide favorable isolation between the divided waveguides and may be used for concurrent transmission and reception of polarized signals.

Septum polarizer performance has become challenged by increases in bandwidth requirements for various applications. For example, in some applications a septum polarizer may be used to convert the polarization of signals at more than one carrier signal frequency, in which case the operational bandwidth of the septum polarizer may be relatively large. Conventional designs may have relatively sharp performance drop-off at the band edges. Accordingly, such designs may have little margin and thus require very tight manufacturing tolerances in order to operate over the desired frequency band, which may be difficult to maintain and expensive.

SUMMARY

Methods, systems and devices are described for enhancing performance of a septum polarizer of a waveguide device using one or more sidewall features. A waveguide device may include one or more sidewall features such as a recess and/or a protrusion. Various parameters of the sidewall feature(s) (e.g., number, location, shape, spacing, size, etc.) may be determined according to a particular design implementation. The sidewall feature(s) thus add degrees of freedom to the design of a waveguide device, which may help with performance optimization and may increase the achievable performance.

Described aspects include a waveguide device comprising a common waveguide section, a divided waveguide section having a first divided waveguide associated with a first basis polarization and a second divided waveguide associated with a second basis polarization, a polarizer section coupled between the common waveguide section and the divided waveguide section, the polarizer section comprising a central axis in a direction between the common waveguide section and the divided waveguide section, a first set of opposing sidewalls, a second set of opposing sidewalls, and a septum extending between the opposing sidewalls of the first set and forming a boundary between the first and second divided waveguides, and at least one sidewall feature on at least one sidewall of the first set of opposing sidewalls.

Further described aspects include a waveguide device comprising a plurality of polarizers, each polarizer having a common waveguide section, a divided waveguide section with a first divided waveguide associated with a first basis polarization and a second divided waveguide associated with a second basis polarization, and a polarizer section coupled between the common waveguide section of the polarizer and the first and second divided waveguides. The polarizer section of each polarizer from the plurality of polarizers may include a central axis in a direction between the common waveguide section and the divided waveguide section, a first set of opposing sidewalls, a second set of opposing sidewalls, and a septum extending between the opposing sidewalls of the first set and forming a boundary between the first and second divided waveguides, and at least one sidewall feature on at least one sidewall of the first set of opposing sidewalls The foregoing has outlined rather broadly the features and technical advantages of examples according to the disclosure in order that the detailed description that follows may be better understood. Additional features and advantages will be described hereinafter. The conception and specific examples disclosed may be readily utilized as a basis for modifying or designing other structures for carrying out the same purposes of the present disclosure. Such equivalent constructions do not depart from the scope of the appended claims. Characteristics of the concepts disclosed herein, both their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the present invention may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Aspects described herein include a sidewall feature, such as a recess or protrusion, on one or more sidewalls of a waveguide device including a polarizer section. For example, the waveguide device may include multiple sidewall features on one or both of a set of opposing sidewalls of the polarizer section. Various parameters of each sidewall feature (e.g., number, location, shape, size, spacing, etc.) may be determined according to a particular design implementation. Each sidewall feature thus adds degrees of freedom to the design of a waveguide device, which may help with performance optimization and may increase the achievable performance.

The sidewall features may be configured to lower the waveguide cutoff values and/or alter the propagation constant, which can provide improvements to the performance and/or design flexibility of the waveguide device. For example, the sidewall features may affect one mode of propagation relative to another mode of propagation due to the placement and characteristics of the sidewall features, which may allow a propagation-mode dependent cutoff frequency to be modified. The addition of one or more sidewall features may allow designs to increase bandwidth margins, which may improve robustness to dimensional variations that may result from various manufacturing processes. This may be beneficial, for example, in relatively high volume applications (e.g., where molding or casting may be employed) to achieve increased yields. Furthermore, an increased bandwidth margin may, for instance, improve the ability to design, manufacture, and/or operate a septum polarizer configured to convert the polarization of signals at more than one carrier signal frequency.

This description provides examples, and is not intended to limit the scope, applicability or configuration of embodiments of the principles described herein. Rather, the ensuing description will provide those skilled in the art with an enabling description for implementing embodiments of the principles described herein. Various changes may be made in the function and arrangement of elements.

Thus, various embodiments may omit, substitute, or add various procedures or components as appropriate. For instance, it should be appreciated that the methods may be performed in an order different than that described, and that various steps may be added, omitted or combined. Also, aspects and elements described with respect to certain embodiments may be combined in various other embodiments. It should also be appreciated that the following systems, methods, devices, and software may individually or collectively be components of a larger system, wherein other procedures may take precedence over or otherwise modify their application.

Figure 1A:
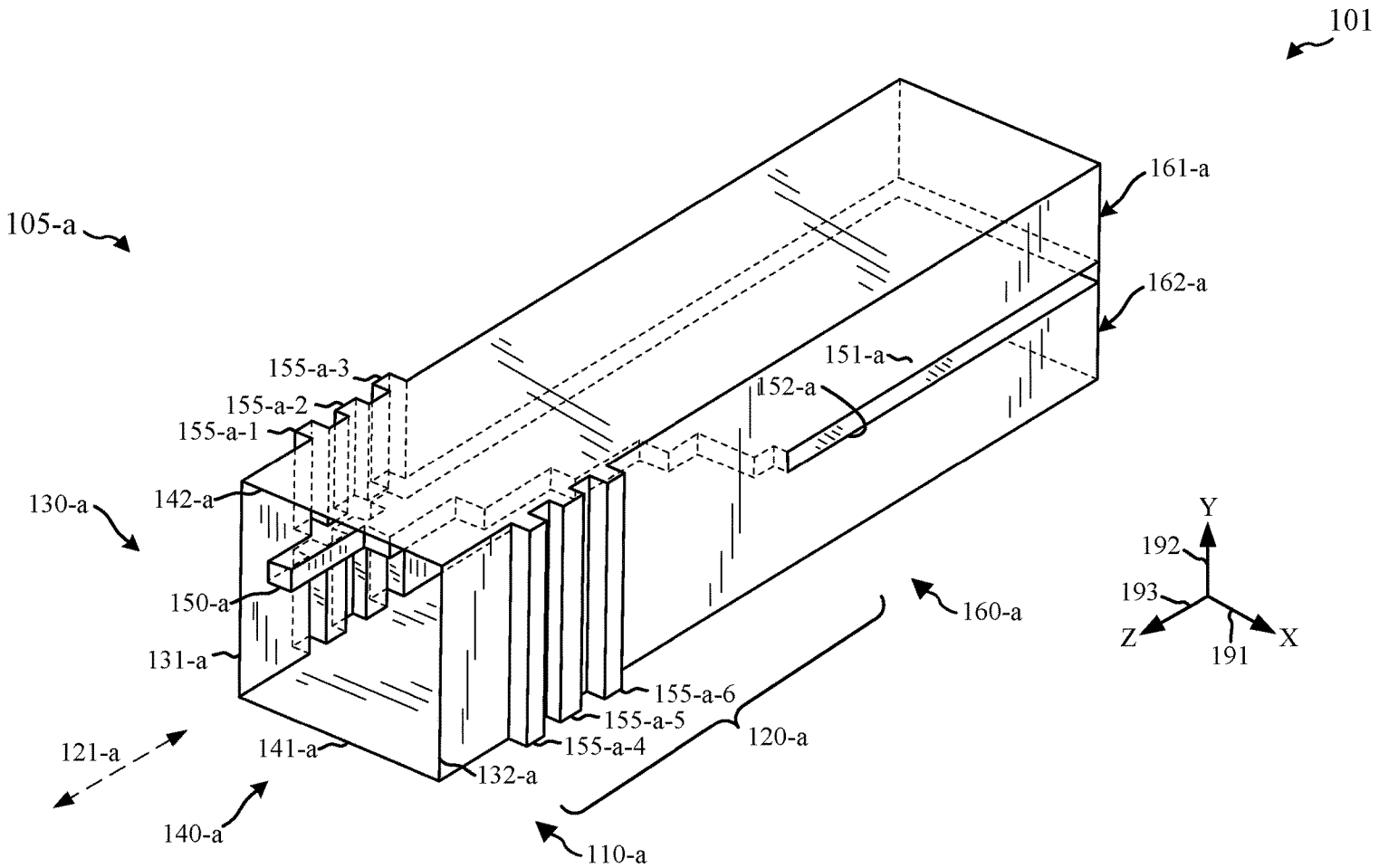
FIGS. 1A and 1B show views of an example waveguide device with sidewall features in accordance with various aspects of the present disclosure.
Figure 1B:
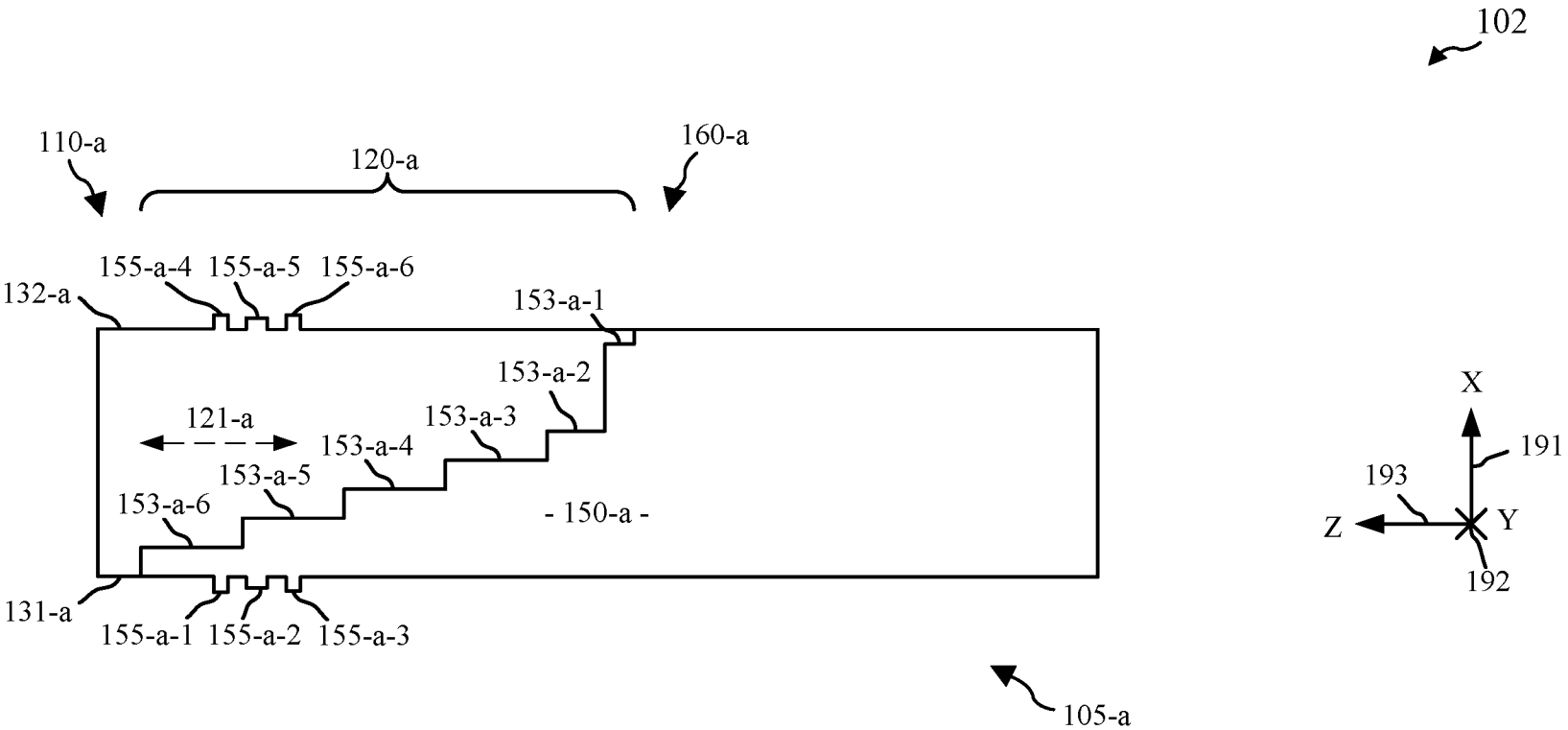

FIGS. 1A and 1B show views of an example waveguide device 105-*a* with sidewall features in accordance with various aspects of the present disclosure. For reference, the waveguide device 105-*a* is shown in FIGS. 1A and 1B relative to an X-axis 191, a Y-axis 192, and a Z-axis 193. The waveguide device 105-*a* may include a common waveguide section 110-*a*, a divided waveguide section 160-*a*, and a polarizer section 120-*a* coupled between the common waveguide section 110-*a* and the divided waveguide section 160-*a*.

The waveguide device 105-*a* can have a central axis 121-*a*, which is along the Z-axis 193. Although the central axis 121-*a* is represented outside the waveguide device 105-*a* for clarity, the central axis 121-*a* can be interpreted as passing through the volume of the waveguide device 105-*a* including the polarizer section 120-*a* in the direction shown. The polarizer section 120-*a* can include a first set of opposing sidewalls 130-*a* including a first sidewall 131-*a* and a second sidewall 132-*a* of the first set of opposing sidewalls 130-*a*. As shown in FIG. 1A, the polarizer section 120-*a* can also include a second set of opposing sidewalls 140-*a* including a first sidewall 141-*a* and a second sidewall 142-*a* of the second set of opposing sidewalls 140-*a*.

The polarizer section 120-*a* may combine/divide signals travelling between the common waveguide section 110-*a* and the divided waveguide section 160-*a* along the central axis 121-*a*. The polarizer section 120-*a* can convert a signal between one or more polarization states in the common waveguide section 110-*a* and two signal components in the individual divided waveguides 161-*a*, 162-*a* (both shown in FIG. 1A) that correspond to orthogonal basis polarizations (e.g., left hand circularly polarized (LHCP) signals, right hand circularly polarized (RHCP) signals, etc.).

A septum 150-*a* may be disposed in the polarizer section 120-*a*, extending between the first sidewall 131-*a* and the second sidewall 132-*a* of the first set of opposing sidewalls 130-*a*. The septum 150-*a* can also have a first surface 151-*a* and a second surface 152-*a* (on the back side of septum 150-*a* in perspective view 101 of FIG. 1A). In some examples, one or both of the first surface 151-*a* and the second surface 152-*a* of the septum 150-*a* can be planar, and in some examples the first surface 151-*a* and the second surface 152-*a* can both be parallel to the central axis 121-*a* (e.g., in the X-Z plane of perspective view 101). The thickness of the septum 150-*a* between the first surface 151-*a* and the second surface 152-*a* can vary from embodiment to embodiment. The thickness of the septum 150-*a* may be significantly smaller than the dimensions of a cavity of the polarizer section 120-*a*. In some examples, the height (e.g., along the Y-axis 192) or width (e.g., along the X-axis 191) of a cross-section of the polarizer section 120-*a* can be at least ten times greater than the thickness of the septum 150-*a*. The septum 150-*a* can have a uniform or non-uniform thickness (e.g., tapered).

The septum 150-*a* provides a boundary between a first divided waveguide 161-*a* and a second divided waveguide 162-*a* and has different effects on different modes of signal propagation in the polarizer section 120-*a* based on their orientation relative to the septum 150-*a*. For example, an RHCP or LHCP signal propagating in the negative Z-axis direction in common waveguide section 110-*a* may be understood as having a $TE_{01}$ mode component signal with its E-field along X-axis 191 and a $TE_{10}$ mode component signal with its E-field along Y-axis 192 having equal amplitudes but offset in phase. As the signal propagates through the polarizer section 120-*a*, the septum 150-*a* acts as a power divider to the $TE_{10}$ mode component signal. However, to the $TE_{01}$ mode component signal, the polarizer section 120-*a* with septum 150-*a* acts like a ridge loaded waveguide with a short aligned with the strongest E-field portion. The ridge-loading effect of the septum 150-*a* effectively increases the electrical length of the polarizer section 120-*a* for the $TE_{01}$ mode component signal, which facilitates phase change and conversion of the $TE_{01}$ mode component signal relative to the $TE_{10}$ mode component signal. As the signal reaches the divided waveguide section 160-*a*, the converted $TE_{01}$ mode component signal may be additively combined with the $TE_{10}$ mode component signal on one side of the septum 150-*a*, while cancelling the $TE_{10}$ mode component signal on the other.

For example, as a received signal wave having LHCP propagates from the common waveguide section 110-*a* through the polarizer section 120-*a*, the $TE_{01}$ mode component signal may, after conversion in the polarizer section 120-*a*, additively combine with the $TE_{10}$ mode component signal on the side of the septum 150-*a* coupled with the first divided waveguide 161-*a*, while cancelling on the side of the septum 150-*a* coupled with the second divided waveguide 162-*a*. Similarly, a signal wave having RHCP may have $TE_{01}$ and $TE_{10}$ mode component signals that additively combine on the side of the septum 150-*a* coupled with the second divided waveguide 162-*a* and cancel each other on the side of the septum 150-*a* coupled with the first divided waveguide 161-*a*. Thus, the first and second divided waveguides 161-*a*, 162-*a* may be excited by orthogonal basis polarizations of polarized waves incident on the common waveguide, and may be isolated from each other. In a transmission mode, excitations of the first and second divided waveguides 161-*a*, 162-*a* (e.g., $TE_{10}$ mode signals) may result in corresponding LHCP and RHCP waves, respectively, emitted from the common waveguide section 110-*a*.

The polarizer section 120-*a* can be configured in a manner that facilitates simultaneous dual-polarized operation. For example, from a signal dividing perspective, the polarizer section 120-*a* can be interpreted as receiving a signal having a combined polarization in the common waveguide section 110-*a*, and substantially transferring energy corresponding to a first basis polarization (e.g., LHCP) of the signal to the first divided waveguide 161-*a*, and substantially transferring energy corresponding to a second basis polarization (e.g., RHCP) of the signal to the second divided waveguide 162-*a*. From a signal combining perspective, the polarizer section 120-*a* can substantially transfer energy from the first divided waveguide 161-*a* to the common waveguide section 110-*a* as a wave having the first basis polarization, and also substantially transfer energy from the second divided waveguide 162-*a* to the common waveguide section 110-*a* as a wave having the second basis polarization such that a combined signal in the common waveguide section 110-*a* is transmitted as a wave having a combined polarization.

The waveguide device 105-*a* may be used to transmit or receive linearly polarized signals having a desired polarization tilt angle at the common waveguide section 110-*a* by changing the relative phase of component signals transmitted or received via the first divided waveguide 161-*a* and second divided waveguide 162-*a*. For example, two equal-amplitude components of a signal may be suitably phase shifted and sent separately to the first divided waveguide 161-*a* and the second divided waveguide 162-*a* of the waveguide device 105-*a*, where they are converted to an LHCP wave and an RHCP wave at the respective phases by the polarizer section 120-*a*. When emitted from the common waveguide section 110-*a*, the LHCP and RHCP waves combine to produce a linearly polarized wave having an orientation at a tilt angle related to the phase shift introduced into the two components of the transmitted signal. The transmitted wave is therefore linearly polarized and can be aligned with a polarization axis of a communication system. In some instances, the waveguide device 105-*a* may operate in a transmission mode for a first polarization (e.g., LHCP, first linear polarization) while operating in a reception mode for a second, orthogonal polarization.

As illustrated in the present example, the common waveguide section 110-*a* has a rectangular (e.g., square) cross sectional opening, shown here as an opening in the x-y plane of the perspective view 101. In other examples, the common waveguide section 110-*a* can have a different cross sectional shape or shapes that provide suitable opening and/or suitable coupling between the common waveguide section 110-*a* and the polarizer section 120-*a*, such as a trapezoid, a rhombus, a polygon, a circle, an oval, an ellipse, or any other suitable shape. In some examples, the common waveguide section 110-*a* may be coupled with an antenna element, such as an antenna horn element.

As illustrated in the present example, the first sidewall 131-*a* and the second sidewall 132-*a* of the first set of opposing sidewalls 130-*a* are parallel, planar surfaces, and on opposite sides of the central axis 121-*a*. The first sidewall 141-*a* and the second sidewall 142-*a* of the second set of opposing sidewalls 140-*a* are also shown in the present example as parallel, planar surfaces, and on opposite sides of the central axis 121-*a*. Thus, each of the first sidewall 141-*a* and the second sidewall 142-*a* of the second set of opposing sidewalls may be orthogonal with each of the first sidewall 131-*a* and the second sidewall 132-*a* of the first set of opposing sidewalls 130-*a*. In this manner, some examples of the waveguide device 105-*a* may have a polarizer section 120-*a* having a volume generally characterized by a rectangular prism. In other examples, the first sidewall 131-*a* and the second sidewall 132-*a* of the first set of opposing sidewalls may be non-parallel, and/or the first sidewall 141-*a* and the second sidewall 142-*a* of the second set of opposing sidewalls 140-*a* may be non-parallel. Furthermore, in various examples of the waveguide device 105-*a*, either of the first sidewall 131-*a* or the second sidewall 132-*a* of the first set of opposing sidewalls 130-*a* may be non-orthogonal with either of the first sidewall 141-*a* or the second sidewall 142-*a* of the second set of opposing sidewalls 140-*a*. Therefore, some examples of the waveguide device 105-*a* may have a polarizer section 120-*a* having a volume generally characterized by a rhombohedral prism, a trapezoidal prism, and the like. In other examples of the waveguide device 105-*a*, the polarizer section 120-*a* may have additional opposing or non-opposing sidewalls, and in such examples the polarizer section 120-*a* may have a volume generally characterized by a polygonal prism, a pyramidal frustum, and the like.

As illustrated in the present example, the distance between the second set of opposing sidewalls 140-*a* does not change through the polarizer section 120-*a*. In other embodiments, this distance may change. For example, the second set of opposing sidewalls 140-*a* may include one or more transitions (e.g., stepped, smooth, etc.) within the polarizer section 120-*a* that reduce the distance of the second set of opposing sidewalls 140-*a* for a least a portion of the polarizer section. For example, the distance between the second set of opposing sidewalls 140-*a* may be a first distance within the common waveguide section 110-*a*, transition to a second distance less than the first distance within a portion of the polarizer section 120-*a* adjacent the common waveguide section 110-*a*, and then transition back to the first distance within a portion of the polarizer section 120-*a* adjacent the divided waveguide section 160-*a*.

In some aspects, the polarizer section 120-*a* includes one or more sidewall features 155. Specifically, as illustrated in the present example, the polarizer section 120-*a* has a first sidewall feature 155-*a*-1, a second sidewall feature 155-*a*-2, and a third sidewall feature 155-*a*-3, each forming a recess in the first sidewall 131-*a* of the first set of opposing sidewalls 130-*a*. A recess in a sidewall may be understood as forming a cavity in the sidewall projecting outwardly (relative to the waveguide volume) from the plane of the sidewall. For example, the sidewall feature 155-*a*-1 forms a cavity projecting into the first sidewall 131-*a* in the negative X-direction. The polarizer section 120-*a* also has a third sidewall feature 155-*a*-3, a fourth sidewall feature 155-*a*-4, and a fifth sidewall feature 155-*a*-5, each forming a recess in the second sidewall 132-*a* of the first set of opposing sidewalls 130-*a*. The polarizer section 120-*a* can have sidewall features 155-*a* on both sidewalls of an opposing set of sidewalls, and/or multiple sidewall features 155-*a* on the same sidewall, in some cases.

Each sidewall feature 155-*a* can have a depth in a direction between the first sidewall 131-*a* and the second sidewall 132-*a* of the first set of opposing sidewalls 130-*a* (e.g., along the X-axis 191), measured from the plane of the sidewall upon which the sidewall feature is located (e.g., the first sidewall 131-*a* or the second sidewall 132-*a* of the first set of opposing sidewalls 130-*a*). Each sidewall feature 155-*a* can have a width in a direction along the central axis 121-*a* (e.g., along the Z-axis 193). Each sidewall feature 155-*a* can have a length in a direction between the first sidewall 141-*a* and the second sidewall 142-*a* of the second set of opposing sidewalls 140-*a* (e.g., along the Y-axis 192).

As illustrated in the present example, different sidewall features 155-*a* may have the same dimensions (e.g., sidewall features 155-*a*-1 and 155-*a*-3 may have the same dimensions), and different sidewall features may have different dimensions (e.g., sidewall features 155-*a*-1 and 155-*a*-2 may have different depth and width dimensions). Furthermore, the present example illustrates the sidewall features 155-*a* having a length that is equal to the distance between the first sidewall 141-*a* and the second sidewall 142-*a* of the second set of opposing sidewalls 140-*a*. Said more generally, a sidewall feature 155-*a* may be coincident with both a first sidewall 141-*a* and a second sidewall 142-*a* of the second set of opposing sidewalls 140-*a*. In other examples, a sidewall feature 155-*a* may have a length that is shorter than the distance between the first sidewall 141-*a* and the second sidewall 142-*a* of the second set of opposing sidewalls 140-*a*. Therefore, in some examples a sidewall feature 155-*a* may be coincident with only one sidewall from the second set of sidewalls 140-*a*, or not be coincident with either sidewall of the second set of opposing sidewalls 140-*a*.

In some examples of the waveguide device 105-*a*, the width of a sidewall feature 155-*a* and/or depth of a sidewall feature 155 may have a particular relationship with a cross-sectional dimension of the polarizer section 120-*a*. For instance, one or more dimensions of a sidewall feature 155 may be significantly smaller than the dimensions of a cavity of the polarizer section 120-*a*, and such a relationship can provide particular desirable performance characteristics of the waveguide device 105-*a*. In some examples, the height (e.g., along the Y-axis 192) or width (e.g., along the X-axis 191) of a cross-section of the polarizer section 120-*a* can be at least five times greater than at least one of the width or the depth of a sidewall feature 155-*a*. In some examples, the height or width of the cross-section of the polarizer section 120-*a* can be at least ten times greater than at least one of the width or the depth of a sidewall feature 155-*a*.

Although multiple sidewall features 155-*a* are shown in the illustrated example, it should be understood that a single sidewall feature 155-*a* may be formed on one or each of the first sidewall 131-*a* or the second sidewall 132-*a* of the first set of opposing sidewalls 130-*a*. Furthermore, the number of sidewall features 155-*a* on the first sidewall 131-*a* of the first set of opposing sidewalls 130-*a* (e.g., zero, one or more) need not be equal to the number (e.g., zero, one or more) of sidewall features 155-*a* on the second sidewall 132-*a* of the first set of opposing sidewalls 130-*a*, nor do sidewall features 155-*a* need to be of the same size or shape.

Additional aspects of the waveguide device 105-*a* of FIG. 1A will be described with reference to FIG. 1B, which shows a cross-sectional view 102 of the waveguide device 105-*a*. FIG. 1B may illustrate, for example, a cross section of the waveguide device 105-*a* in the X-Z plane.

The septum 150-*a* may include multiple stepped surfaces 153-*a*-1, 153-*a*-2, 153-*a*-3, 153-*a*-4, 153-*a*-5 and 153-*a*-6, where each of the stepped surfaces 153-*a* are perpendicular to the first surface 151-*a* and the second surface 152-*a* of the septum 150-*a* and parallel to the central axis 121-*a* (e.g., each stepped surface 153-*a* is parallel to the Y-Z plane).

As noted above, the sidewall features 155-*a* may be located on both the first sidewall 131-*a* and the second sidewall 132-*a* of the first set of opposing sidewalls 130-*a*. It should be understood that this arrangement is only an example and the sidewall feature(s) 155-*a* may be located in various positions or configurations along the first sidewall 131-*a* or the second sidewall 132-*a* of the first set of opposing sidewalls 130-*a*. In some cases, locating the sidewall feature(s) 155-*a* within a portion of the polarizer section 120-*a* closer to the common waveguide section 110-*a* (e.g., within a region of the polarizer section 120-*a* corresponding to stepped surfaces 153-*a*-4, 153-*a*-5, and/or 153-*a*-6 as shown) may provide a greater effect. Alternatively, the sidewall feature(s) 155-*a* may be located within a middle or central portion of the polarizer section 120-*a*.

In some examples, one or more sidewall features 155-*a* can be aligned with one another, where aligned sidewall features 155-*a* are on opposite sidewalls of the first set of opposing sidewalls 130-*a* and have at least one characteristic (e.g., edge, center of the width dimension, etc.) at the same position along the central axis 121-*a*. For example, the first sidewall feature 155-*a*-1 and the fourth sidewall feature 155-*a*-4 can have edges closest to the common waveguide 110-*a* that are at the same position along the central axis 121-*a*. In some examples, sidewall features 155-*a* on the same sidewall may be equally spaced apart from one another. For example, the spacing between the first sidewall feature 155-*a*-1 and the second sidewall feature 155-*a*-2 is equal to the spacing between the second sidewall feature 155-*a*-2 and the third sidewall feature 155-*a*-3. In other examples, the spacing between sidewall features 155-*a* may be unequal, or some sidewall features 155-*a* may be equally spaced while other sidewall features 155-*a* are unequally spaced.

In the present example of the waveguide device 105-*a*, the first sidewall feature 155-*a*-1, the third sidewall feature 155-*a*-3, the fourth sidewall feature 155-*a*-4 and the sixth sidewall feature 155-*a*-6 each have a square cross-sectional shape (i.e., a square shape as viewed in the X-Z plane), whereas the second sidewall feature 155-*a*-2 and the fifth sidewall feature 155-*a*-5 each have a rectangular cross-sectional shape. In various other examples of a waveguide device 105, sidewall features 155 may have any suitable cross-sectional shape, which may or may not be the same as another sidewall feature 155 of the waveguide device 105.

The waveguide device 105-*a* illustrated in FIGS. 1A and 1B may be an example of a dual-band device, where a dual-band signal is characterized by operation using two signal carrier frequencies. In such case, a substantial increase in performance may be achieved in a lower frequency band of the dual band signal (which may otherwise be relatively sensitive to manufacturing tolerances) using one or more sidewall features 155 in the polarizer section 120-*a*, while some increase in performance in a higher frequency band of the dual-band signal also may be achieved.

For example, polarization characteristics of the waveguide device 105-*a* may be measured by axial ratio performance. In some cases, a desired objective for performance may be an axial ratio of less than one decibel (dB), which corresponds to a cross-polarization discrimination (XPD) of less than 24.8 dB. The axial ratio performance is generally limited by the quadrature phase relationship achievable in the common waveguide section 110-*a* between the $TE_{10}$ and $TE_{01}$ orthogonal modes (e.g., the quadrature phase error between these modes in the common waveguide section 110-*a*). As discussed above, the propagation of these two modes is different In the polarizer section 120-*a* due to the septum 150-*a*. The waveguide cutoff values for these modes may limit the axial ratio performance that is achievable.

The mode corresponding to the septum acting as an E-plane ridge (e.g., the $TE_{01}$ mode) may have a reduced lower cutoff frequency than the orthogonal mode (e.g., $TE_{10}$ mode). The sidewall feature(s) 155 described herein may create an artificial boundary condition (e.g., a surface impedance or perturbation) along the first set of sidewalls 130-*a* of the polarizer section 120-*a* which may alter the propagation constant for the $TE_{10}$ mode. The different propagation constant created by the sidewall features in the polarizer section 120-*a* may alter the propagation characteristics for the $TE_{10}$ mode without altering the propagation characteristics for the $TE_{01}$ mode. As a result, the sidewall feature(s) 155 provide an additional degree of freedom for achieving the desired phase relationship between the $TE_{10}$ and $TE_{01}$ modes. Using the additional degree of freedom, performance at lower and/or higher operational frequencies can be improved, such that performance objectives such as a desired operational bandwidth, axial ratio (e.g., less than 1 dB), and/or cross-polarization discrimination may be achieved. For example, in dual-band operation, the axial ratio and cross-polarization discrimination may be improved in one or both of the lower frequency band or the higher frequency band. This also may provide increased bandwidth margins to allow for manufacturing tolerances. Although described with reference to multi-band operation, the sidewall feature(s) described herein also may be employed for the design of single-band waveguide devices to improve the performance in the single bandwidth (e.g., higher broadband performance, etc.).

Although six stepped surfaces 153-*a* are shown in FIGS. 1A and 1B, it should be understood that other numbers of stepped surfaces 153 may be employed for a septum 150. Further, it should be understood that other configurations of the septum 150 (e.g., curved, sloped, combination curved and stepped, combination sloped and stepped, etc.) may be used depending on the particular design implementation.

The first sidewall 131-*a* of the first set of opposing sidewalls 130-*a* can be understood as a single sidewall extending between the second set of opposing sidewalls 140-*a* or as multiple sidewalls separated by septum 150-*a*. The multiple sidewalls may be coplanar, or, in other examples, may not be coplanar, and may have a different distance of separation along the X-axis 191 from the second sidewall 132-*a* of the first set of opposing sidewalls 130-*a*.

FIGS. 2-5 show exemplary cross-sectional views of waveguide devices 105 in accordance with various aspects of the present disclosure. It will be readily understood by one skilled in the related arts that various aspects of the waveguide devices 105 described with reference to FIGS. 2-5 can share any of the aspects described with respect to the waveguide device 105-*a* illustrated in FIGS. 1A and 1B, including those aspects relating to the common waveguide section 110-*a*, the polarizer section 120-*a*, and the divided waveguide section 160-*a*. Those descriptions are equally applicable to the waveguide devices 105 of FIGS. 2-5 and are therefore omitted in the respective descriptions of these figures for brevity.

Figure 2:
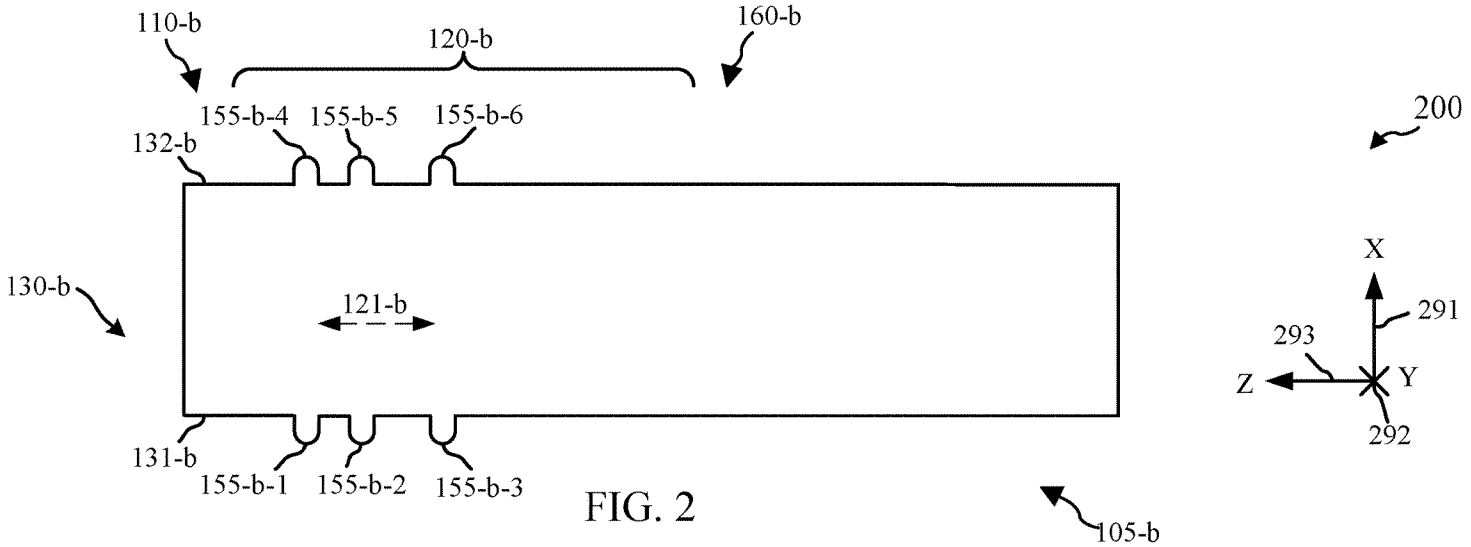
FIG. 2 shows a cross-sectional view of a waveguide device in accordance with various aspects of the present disclosure.

FIG. 2 shows a cross-sectional view 200 of a waveguide device 105-*b*, shown with respect to an X-axis 291, a Y-axis 292, and a Z-axis 293, in accordance with various aspects of the present disclosure. View 200 shows a common waveguide section 110-*b*, a divided waveguide section 160-*b*, and a polarizer section 120-*b* coupled between the common waveguide section 110-*b* and the divided waveguide section 160-*b* of the waveguide device 105-*b*. The waveguide device 105-*b* also has a central axis 121-*b* in a direction between the common waveguide section and the divided waveguide section 160-*b*, as well as a first sidewall 131-*b* and a second sidewall 132-*b* of a first set of opposing sidewalls 130-*b*.

As shown in FIG. 2, the waveguide device 105-*b* includes a first sidewall feature 155-*b*-1, a second sidewall feature 155-*b*-2 and a third sidewall feature 155-*b*-3 formed on the first sidewall 131-*b* of the first set of opposing sidewalls 130-*b*. Waveguide device 105-*b* further includes a fourth sidewall feature 155-*b*-4, a fifth sidewall feature 155-*b*-5, and a sixth sidewall feature 155-*b*-6, formed on the second sidewall 132-*b* of the first set of opposing sidewalls 130-*b*. In the present example, each of the sidewall features 155-*b* are formed as a recess in the respective sidewall of the first set of opposing sidewalls 130-*b*. The recess may be in the form of a channel extending along the respective sidewall of the first set of opposing sidewalls 130-*b* in a direction orthogonal to the central axis 121-*b* (i.e., extending along the Y-axis 292). The sidewall features 155-*b* may be within the polarizer section 120-*b*, which in some examples may include a septum 150 (not shown).

In FIG. 2, each of the sidewall features 155-*b*-1, 155-*b*-2, and 155-*b*-3 is aligned (e.g., at the same position along the central axis 121-*b*) with a respective one of the sidewall features 155-*b*-4, 155-*b*-5, and 155-*b*-6. In other examples, sidewall features 155-*b* may be in various positions along the central axis such that individual sidewall features may or may not be aligned with another sidewall feature 155-*b* along the central axis 121-*b*.

In various examples, sidewall features 155-*b* may be unequally spaced apart from one another. For example, the spacing between the first sidewall feature 155-*b*-1 and the second sidewall feature 155-*b*-2 along the first sidewall 131-*b* of the first set of opposing sidewalls 130-*b* (i.e., along the central axis 121-*b*) is different from the spacing between the second sidewall feature 155-*b*-2 and the third sidewall feature 155-*b*-3. As previously described, in other examples of a waveguide device 105, the spacing between sidewall features may be equal.

In FIG. 2, the sidewall features 155-*b* have a U-shaped cross-section. That is, the sidewall features 155-*b* may be a recess or protrusion with at least a portion of the cross-section in the X-Z plane being curved or semi-circular. The cross section of each sidewall feature 155-*b* may have the same dimensions (as shown) or different dimensions from one another.

Figure 3:
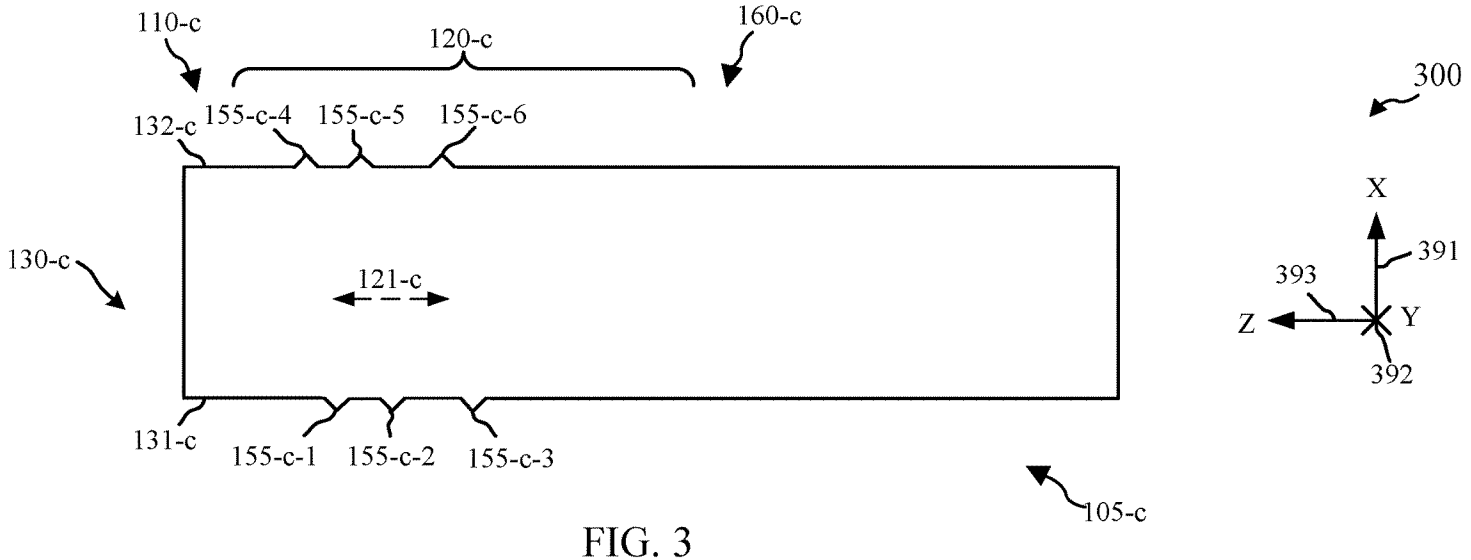
FIG. 3 shows a cross-sectional view of a waveguide device in accordance with various aspects of the present disclosure.

FIG. 3 shows a cross-sectional view 300 of a waveguide device 105-*c*, shown with respect to an X-axis 391, a Y-axis 392, and a Z-axis 393, in accordance with various aspects of the present disclosure. The waveguide device 105-*c* has a common waveguide section 110-*c*, a divided waveguide section 160-*c*, and a polarizer section 120-*c* coupled between the common waveguide section 110-*c* and the divided waveguide section 160-*c*. The waveguide device 105-*c* also has a central axis 121-*c* in a direction between the common waveguide section and the divided waveguide section 160-*c*, as well as a first sidewall 131-*c* and a second sidewall 132-*c* of a first set of opposing sidewalls 130-*c*.

As shown in FIG. 3, the waveguide device 105-*c* includes a first sidewall feature 155-*c*-1, a second sidewall feature 155-*c*-2 and a third sidewall feature 155-*c*-3 formed on the first sidewall 131-*c* of the first set of opposing sidewalls 130-*c*. Waveguide device 105-*c* further includes a fourth sidewall feature 155-*c*-4, a fifth sidewall feature 155-*c*-5, and a sixth sidewall feature 155-*c*-6, formed on the second sidewall 132-*c* of the first set of opposing sidewalls 130-*c*. In the present example, each of the sidewall features 155-*c* are formed as a recess in the respective sidewall of the first set of opposing sidewalls 130-*c*. The recess may be in the form of a channel (e.g., a recess having a length along the Y-axis 292 greater than the width along the Z-axis 293) extending along the respective sidewall of the first set of opposing sidewalls 130-*c* in a direction orthogonal to the central axis 121-*c* (e.g., extending along the Y-axis 292). The sidewall features 155-*c* may be within the polarizer section 120-*c*, which in some examples may include a septum 150 (not shown).

As illustrated in the present example, the group of sidewall features 155-*c*-1, 155-*c*-2, and 155-*c*-3 may be offset (e.g., not aligned) along the central axis 121-*c* relative to the group of sidewall features 155-*c*-4, 155-*c*-5, and 155-*c*-6. In various other examples, only some, one or none of the sidewall features 155-*c* on one of the sidewalls of the first set of opposing sidewalls may be offset from a corresponding sidewall feature 155-*c* on another of the first set of opposing sidewalls 130-*c*.

As illustrated in the present example, each of the sidewall features 155-*c* have a triangular or V-shaped cross-section in the X-Z plane. In various examples, the cross section of each sidewall feature 155-*c* may have the same dimensions (as shown) or different dimensions from one another.

Figure 4:
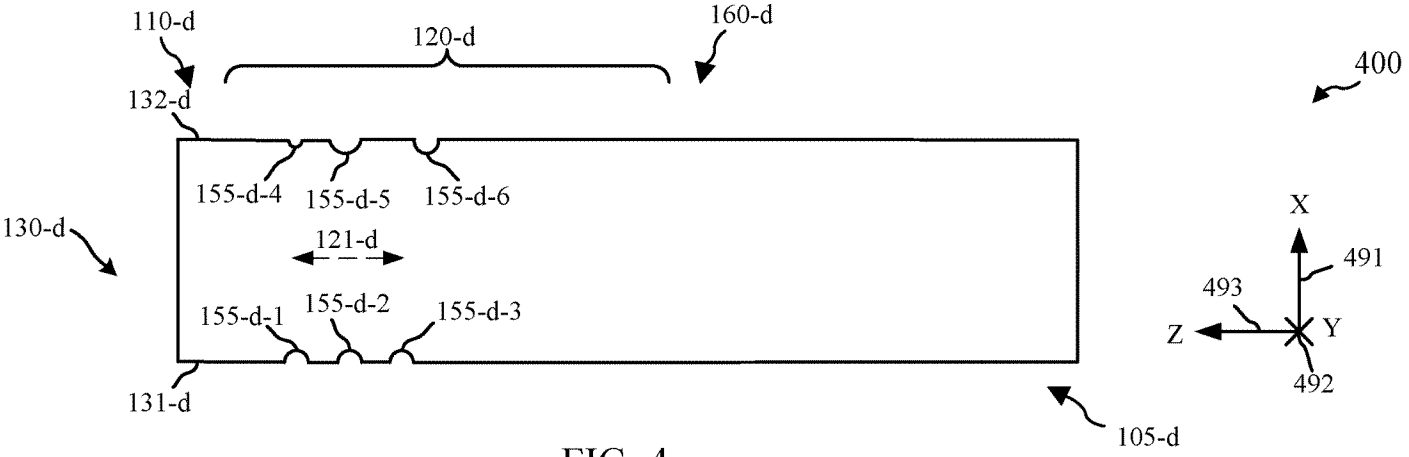
FIG. 4 shows a cross-sectional view of a waveguide device in accordance with various aspects of the present disclosure.

FIG. 4 shows a cross-sectional view 400 of a waveguide device 105-*d*, shown with respect to an X-axis 491, a Y-axis 492, and a Z-axis 493, in accordance with various aspects of the present disclosure. The waveguide device 105-*d* has a common waveguide section 110-*d*, a divided waveguide section 160-*d*, and a polarizer section 120-*d* coupled between the common waveguide section 110-*d* and the divided waveguide section 160-*d*. The waveguide device 105-*d* also has a central axis 121-*d* in a direction between the common waveguide section and the divided waveguide section 160-*d*, as well as a first sidewall 131-*d* and a second sidewall 132-*d* of a first set of opposing sidewalls 130-*d*.

As shown in FIG. 4, the waveguide device 105-*d* includes a first sidewall feature 155-*d*-1, a second sidewall feature 155-*d*-2 and a third sidewall feature 155-*d*-3 formed on the first sidewall 131-*d* of the first set of opposing sidewalls 130-*d*. Waveguide device 105-*d* further includes a fourth sidewall feature 155-*d*-4, a fifth sidewall feature 155-*d*-5, and a sixth sidewall feature 155-*d*-6, formed on the second sidewall 132-*d* of the first set of opposing sidewalls 130-*d*. In waveguide device 105-*d*, each of the sidewall features 155-*d* are formed as a protrusion on the respective sidewall of the first set of opposing sidewalls 130-*c*. A protrusion on a sidewall may be understood as a discontinuity of the surface of the sidewall projecting inward (relative to the waveguide volume) from the plane of the sidewall. For example, the sidewall feature 155-*d*-1 is a protrusion forming a discontinuity of the surface of the first sidewall 131-*d* projecting inward (in the positive X-direction from the first sidewall 131-*d*) into the volume of the waveguide device 105-*d*. The protrusion may be in the form of a ridge (e.g., a protrusion having a length along the Y-axis 492 greater than a width along the Z-axis 493) extending along the respective sidewall of the first set of sidewalls 130-*d* in a direction orthogonal to the central axis 121-*d* (e.g., extending along the Y-axis 492). The sidewall features 155-*d* may be within the polarizer section 120-*d*, which in some examples may include a septum 150.

As illustrated FIG. 4, the sidewall features 155-*d* each have a U-shaped cross-sectional shape in the X-Z plane. Furthermore, as shown, the first sidewall feature 155-*d*-1, second sidewall feature 155-*d*-2 and the third sidewall feature 155-*d*-3 have the same height and width, while the fourth sidewall feature 155-*d*-4, the fifth sidewall feature 155-*d*-5, and the sixth sidewall feature 155-*d*-6 each have a different height and/or width.

Figure 5:
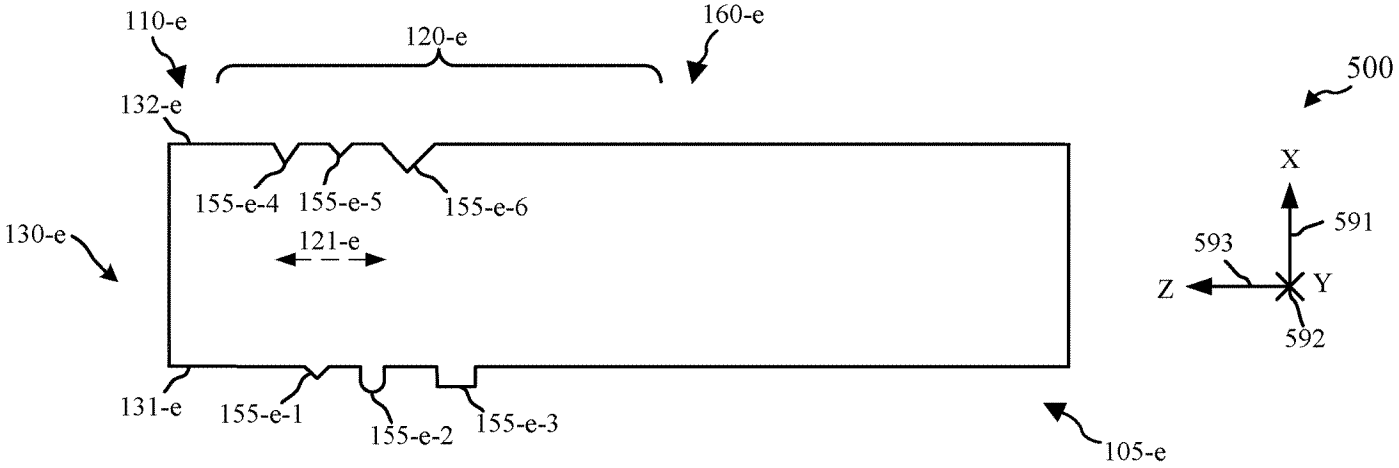
FIG. 5 shows a cross-sectional view of a waveguide device in accordance with various aspects of the present disclosure.

FIG. 5 shows a cross-sectional view 500 of a waveguide device 105-*e*, shown with respect to an X-axis 591, a Y-axis 592, and a Z-axis 593, in accordance with various aspects of the present disclosure. The waveguide device 105-*e* has a common waveguide section 110-*e*, a divided waveguide section 160-*e*, and a polarizer section 120-*e* coupled between the common waveguide section 110-*e* and the divided waveguide section 160-*e*. The waveguide device 105-*e* also has a central axis 121-*e* in a direction between the common waveguide section and the divided waveguide section 160-*e*, as well as a first sidewall 131-*e* and a second sidewall 132-*e* of a first set of opposing sidewalls 130-*e*.

As shown in FIG. 5, the waveguide device 105-*e* includes a first sidewall feature 155-*e*-1, a second sidewall feature 155-*e*-2 and a third sidewall feature 155-*e*-3 formed on the first sidewall 131-*e* of the first set of opposing sidewalls 130-*e*. Waveguide device 105-*e* further includes a fourth sidewall feature 155-*e*-4, a fifth sidewall feature 155-*e*-5, and a sixth sidewall feature 155-*e*-6, formed on the second sidewall 132-*e* of the first set of opposing sidewalls 130-*e*. In waveguide device 105-*e*, sidewall features 155-*e*-1, 155-*e*-2, and 155-*e*-3 are recesses in the first sidewall 131-*e* of the first set of opposing sidewalls 130-*e*, while the sidewall features 155-*e*-4, 155-*e*-5, and 155-*e*-6 are protrusions in the second sidewall 132 -*e* of the first set of opposing sidewalls 130-*e*.

In FIG. 5, the group of sidewall features 155-*e*-1, 155-*e*-2, and 155-*e*-3 may be offset along the central axis 121-*e* relative to (e.g., not directly across from) the group of sidewall features 155-*e*-4, 155-*e*-5, and 155-*e*-6. In various other examples, only some, one or none of the sidewall features 155-*e* on one of the sidewalls of the first set of opposing sidewalls may be offset with a corresponding sidewall feature 155-*e* on another of the first set of opposing sidewalls 130-*e*.

In various examples, the sidewall features 155-*e* along a sidewall of the first set of opposing sidewalls may each have a different cross-sectional shape. Specifically, the first sidewall feature 155-*e*-1 has a triangular or V-shaped cross-sectional shape, the second sidewall 155-*e*-2 has a U-shaped cross sectional shape, and the third sidewall feature 155-*e*-3 has a rectangular shape in waveguide device 105-*e*. In contrast, the sidewall features on the second sidewall 132-*e* of the first set of opposing sidewalls 130-*e* each have the same cross -sectional shape (i.e., triangular, or V-shaped). Furthermore, as illustrated in FIG. 5, one or more sidewall features 155-*e* having the same shape may have different dimensions (e.g., height and/or width) from one another.

It should be understood that the sidewall features and arrangements shown in FIGS. 1A, 1B, and 2-5 are only examples and that the dimensions of the sidewall feature(s) may be varied to achieve different performance characteristics of a waveguide device 105 as may be desirable for a given application or implementation. Specifically, the variations for the sidewall features described above with reference to FIGS. 1A, 1B, 2, 3, 4 and 5, may be combined in still further arrangements. For example, while sidewall features 155 on a same sidewall are shown as either recesses only or protrusions only, it should be understood that various combinations of recesses and protrusions may be used to implement sidewall features for a waveguide device. Furthermore, while FIGS. 1A, 1B, 2, 3, 4, and 5 show sidewall features 155 as being formed on a first set of opposing sidewalls 130 of a waveguide device 105, sidewall features 155 may also be formed, additionally or alternatively, on a second set of opposing sidewalls 140. For example, a first set of sidewall features including at least one recess may be implemented on the first set of opposing sidewalls 130 while a second set of sidewall features including at least one protrusion may be implemented on the second set of opposing sidewalls 140.

As another example, while the illustrated waveguide devices 105 show recessed sidewall features 155 as hollow, it should be understood that the recesses may be filled, either partially or entirely, with another material (e.g., a dielectric insert). Although a waveguide device 105 may be described as having a cavity between opposing sets of sidewalls, part or all of the volume between opposing sets of sidewalls may be filled with some other material. In such examples, sidewall features formed by recesses may be filled with the same material or a different material from a material filling the volume between opposing sets of sidewalls. Similarly, while FIGS. 4 and 5 show protrusions as formed by the sidewalls themselves, it should be understood that the protrusions may be formed, either partially or entirely, by another material disposed on the sidewalls.

In some examples, a sidewall feature 155 may be formed monolithically with a sidewall of a waveguide device 105, in which case the sidewall feature 155 and the sidewall may be formed from a single volume of material or workpiece. In some examples, at least a portion of one or more sidewall features 155, a first sidewall 131 and a second sidewall 132 of a first set of opposing sidewalls 130, a first sidewall 141 and a second sidewall 142 of a second set of opposing sidewalls 140, or a septum 150 may be formed monolithically, and/or from a single workpiece. For instance, the aforementioned components may be manufactured by such additive processes as molding, casting, 3-d printing, and the like. Additionally or alternatively, the aforementioned components may be manufactured by such subtractive processes as machining, grinding, polishing, electron-discharge machining, water jet cutting, laser cutting, and the like. Additionally or alternatively, the material of one or more sidewall features 155 may be different from a material of one or more of a septum 150, a first sidewall 131 and a second sidewall 132 of a first set of opposing sidewalls 130, or a first sidewall 141 and a second sidewall 142 of a second set of opposing sidewalls 140.

In some examples, any of the aforementioned components may be formed individually, and then coupled together using such means as gluing, soldering, brazing, welding, and/or mechanical fastening. In some examples, such coupling may provide a degree of electrical, electromagnetic, thermal, and/or other form of coupling and/or isolation between a sidewall feature 155 and a sidewall. In some examples one or more of the aforementioned components may be formed from a volume of material that is subsequently coated. As a non-limiting example, for instance, the volume a sidewall may be formed from a first material, and the volume of a sidewall feature, such as a ridge, may be formed from a second material. In various examples the sidewall and the sidewall feature can be coupled with each other, and then coated with a third material such as a metal foil, a dielectric coating, or any other suitable coating which coats at least a portion of the coupled sidewall and sidewall feature. Coatings may be applied by any suitable process, such as spraying, powder coating, vapor depositing, anodizing, immersion, chemical conversion, and the like.

Figure 6:
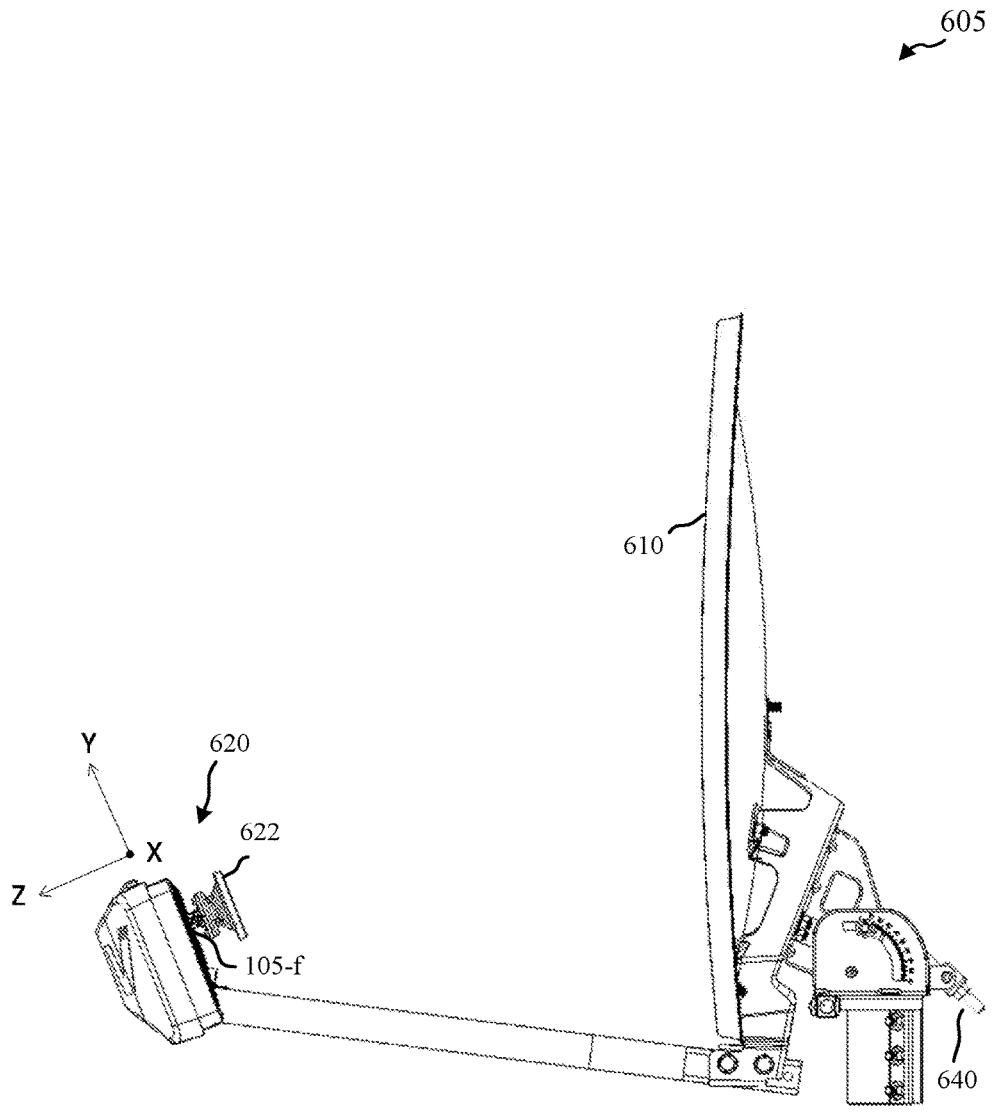
FIG. 6 shows a side view of a satellite antenna implementing a waveguide device in accordance with various aspects of the disclosure.

FIG. 6 shows a side view of a satellite antenna 605 implementing a waveguide device in accordance with various aspects of the disclosure. The satellite antenna 605 may be part of a satellite communication system, for example. The satellite antenna 605 may include a reflector 610 (e.g., dish) and a satellite communication assembly 620 (e.g., a feed assembly subsystem). The satellite communication assembly 620 includes a waveguide device 105-*f*, which may additionally be coupled with a feed horn assembly 622 (e.g., an antenna element). The waveguide device 105-*f* may be an example of aspects of waveguide devices 105 as described with reference to FIGS. 1A, 1B, 2, 3, 4, or 5. The satellite communication assembly 620 may process signals transmitted by and/or received at the satellite antenna 605. In some examples, the satellite communication assembly 620 may be a transmit and receive integrated assembly (TRIA), which may be coupled with a subscriber terminal via an electrical feed 640 (e.g., a cable).

As illustrated, the satellite communication assembly 620 may have the feed horn assembly 622 opening toward the reflector 610. Electromagnetic signals may be transmitted by and received at the satellite communication assembly 420, with electromagnetic signals reflected by the reflector 610 from/to the satellite communication assembly 620. In some examples, the satellite communication assembly 620 may further include a sub-reflector. In such examples, electromagnetic signals may be transmitted by and received at the satellite communication assembly 620 via downlink and uplink beams reflected by the sub-reflector and the reflector 610.

The waveguide device 105-*f* may be used to transmit a first component signal from satellite antenna 605 using a first polarization (e.g., LHCP, etc.) by exciting the corresponding divided waveguide of the waveguide device 105-*f*. The waveguide may also be used to transmit a second component signal from satellite antenna 605 using a second polarization orthogonal to the first polarization (e.g. RHCP, etc.) by exciting a different corresponding divided waveguide of the waveguide device 105-*f*. Additionally or alternatively, the waveguide device may be used to transmit one or more combined signals (e.g., linearly polarized signals) by concurrent excitation of the divided waveguides by two component signals having an appropriate phase offset.

Similarly, when a signal wave is received by satellite antenna 605, the waveguide device 105-*f* directs the energy of the received signal with a particular basis polarization to the corresponding divided waveguide. In some examples the satellite antenna may receive a combined signal (e.g., linearly polarized signal) and separate the combined signal into two component signals in the divided waveguides, which may be phase adjusted and processed to recover the combined signal. The satellite antenna 605 may be used for receiving communication signals from a satellite, transmitting communication signals to the satellite, or bi-directional communication with the satellite (transmitting and receiving communication signals).

In some examples, the satellite antenna 605 may transmit energy using a first polarization and receive energy of a second (e.g., orthogonal) polarization concurrently. In such an example, the waveguide device 105-*f* may be used to transmit a first signal from satellite antenna 605 using a first polarization (e.g., first linear polarization, LHCP, etc.) by appropriate excitation of the divided waveguide(s) of the waveguide device 105-*f*. Concurrently, the satellite antenna can receive a signal of the same or a different frequency having a component signal with a second polarization (e.g., second linear polarization, RHCP, etc.), where the second polarization is orthogonal to the first polarization. The waveguide device 105-*f* can direct the energy of the received signal to the divided waveguide(s) for processing in a receiver to recover and demodulate the received signal.

In various examples the satellite communication assembly 620 can be used to receive and/or transmit single-band, dual-band, and/or multi-band signals. For instance, in some examples signals received and/or transmitted by the satellite communication assembly 620 may be characterized by multiple carrier frequencies in a frequency range of 17.5 to 31 GHz. In such examples, the performance of the waveguide device 105-*f* can be improved by including various sidewall features as described above.

In particular, waveguide device 105-*f* may include one or more sidewall features such as a sidewall feature 155. Various parameters of each sidewall feature 155 (e.g., number, location, shape, size, spacing, etc.) may be determined according to a particular design implementation. Each sidewall feature adds degrees of freedom to the design of waveguide device 105-*f*, which may help with performance optimization and may increase the achievable performance. For example, the addition of one or more sidewall features 155 may allow designs to increase bandwidth margins, which may improve robustness to dimensional variations that may result from various manufacturing processes. This may be beneficial, for example, in relatively high volume applications (e.g., where molding or casting may be employed) to achieve increased yields. Furthermore, an increased bandwidth margin may, for instance, improve the ability to design, manufacture, and/or operate a septum polarizer configured to convert the polarization of signals at more than one carrier signal frequency.

Figure 7:
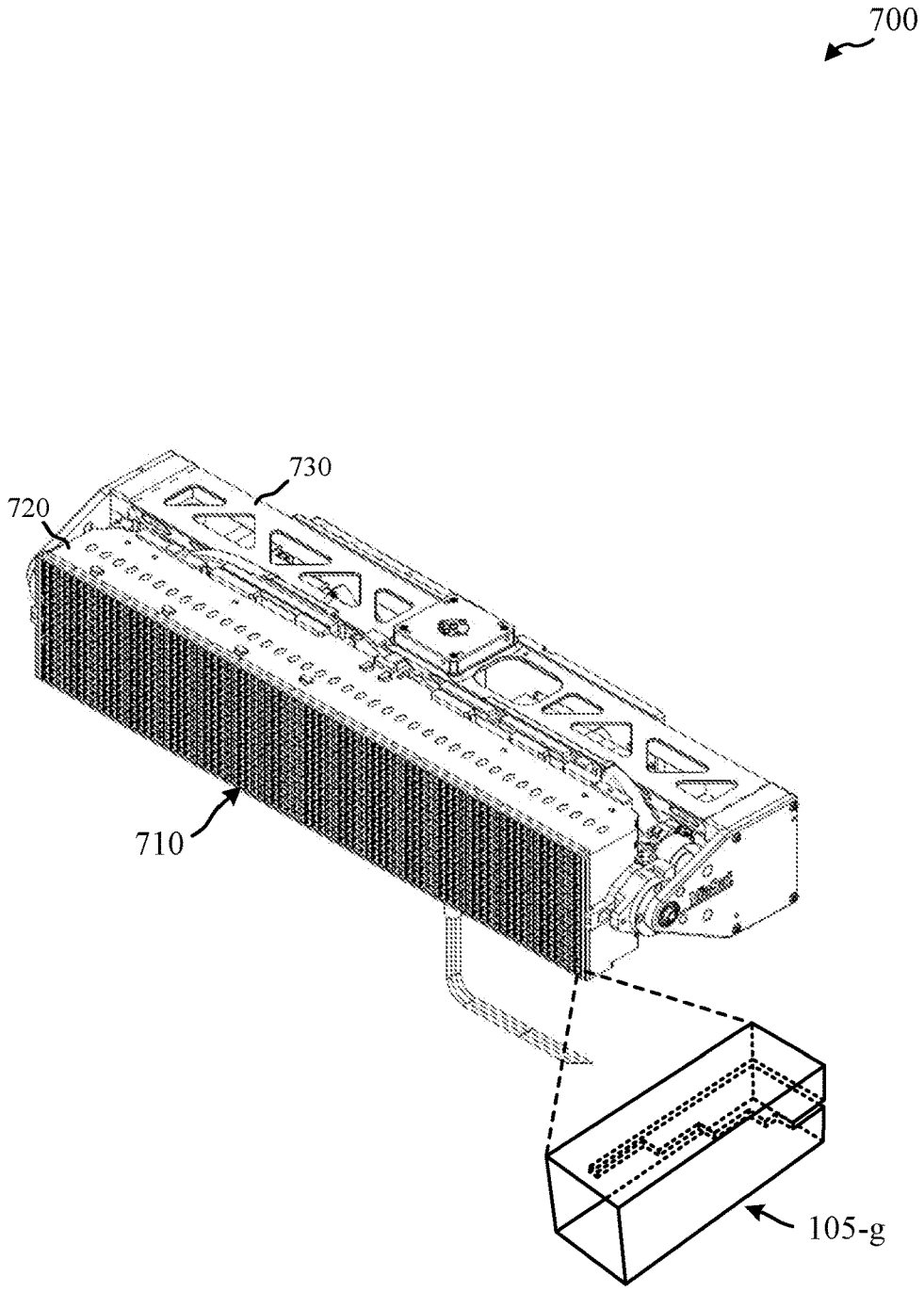
FIG. 7 shows a view of an antenna assembly implementing a waveguide device in accordance with various aspects of the present disclosure.

FIG. 7 shows a view of an antenna assembly 700 implementing a waveguide device in accordance with various aspects of the present disclosure. As shown in FIG. 7, the antenna assembly 700 includes an antenna 710 (e.g., a dual-polarized antenna) and an antenna positioner 730. The antenna positioner 730 may include various components (e.g., motors, gearboxes, sensors, etc.) that may be used to point the antenna 710 at a satellite during operation (e.g., actively tracking). The antenna 710 may operate in the International Telecommunications Union (ITU) Ku, K, or Ka-bands, for example from approximately 17 to 31 GigaHertz (GHz). Alternatively, the antenna 710 may operate in other frequency bands such as C-band, X-band, S-band, L-band, and the like.

The antenna 710 may include a beam forming network 720 and/or a polarization control network (not shown) to provide a planar horn antenna aperture. The polarization control network may combine/divide signals corresponding to the divided waveguides, for example as described in U.S. Pat. No. 9,571,183, issued Feb. 14, 2017, entitled "Systems and Methods for Polarization Control," which is incorporated by reference herein. The beam forming network 720 may include multiple antenna elements. One or more antenna elements of the beam forming network 720 may be associated with a waveguide device 105-*g* for polarization combining/dividing. The waveguide device 105-*g* may be an example of the waveguide devices 105 described with reference to FIGS. 1A, 1B, 2, 3, 4, or 5. The waveguide device 105-*g* may include a polarizer section 120 (e.g., a septum 150) for dual-polarization operation.

The beam forming network 720 may include one or more waveguide combiner/divider networks connecting respective divided waveguides of the waveguide devices 105-*g* with common network ports associated with each basis polarization. For instance, in some examples the beam forming network 720 may include a waveguide feed network comprising one or more waveguide junctions that combine/divide signals between a first common network port and the divided waveguides from multiple waveguide devices 105-*g* associated with a first basis polarization. In other examples, the beam forming network 720 may include an electrical feed network comprising one or more circuits that electrically couple with corresponding divided waveguides, such as a microstrip feed network. Additionally or alternatively, certain divided waveguides from one or more waveguide devices 105-*g* of the beam forming network 720 may be configured to operate independently from other waveguide devices 105-*g* of the beam forming network 720 (e.g., separate transmission and/or receive circuits, etc.).

In various examples of an antenna, multiple waveguide devices 105-*g* may be arranged in an array. For instance, as illustrated in the present example, multiple waveguide devices 105-*g* are arranged in a rectangular array, where "rectangular" refers to the shape of the area occupied by the multiple waveguide devices 105-*g* in a plane orthogonal to a central axis of a waveguide device, and/or the boresight of the antenna 710. Other shapes of an array may include a square, a circle, an ellipse, a polygon, or any other shape suitable for an array of waveguide devices 105-*g*. Additionally or alternatively, an array may refer to a grid array, where waveguide devices 105-*g* may be aligned in both rows and columns. Alternatively, an array may refer to a transversely staggered array, where waveguide devices may be aligned in one transverse direction, and staggered in another transverse direction (e.g., aligned in a column direction, and staggered in a row direction, or vice versa), where transverse refers to the direction orthogonal to a central axis of a waveguide device 105-*g* and/or the principal axis of the antenna 710. Additionally or alternatively, an array may refer to an axially staggered array, where waveguide devices 105-*g* may not all be aligned in an axial direction, where axial refers to a direction along the central axis of a waveguide device 105-*g* and/or a principal axis of the antenna 710.

The waveguide devices 105-*g* may be used to transmit a first component signal from antenna 710 using a first polarization (e.g., LHCP, etc.) by exciting the corresponding divided waveguides of the waveguide devices 105-*g*. The waveguide devices 105-*g* may also be used to transmit a second component signal from antenna 710 using a second polarization orthogonal to the first polarization (e.g. RHCP, etc.) by exciting different corresponding divided waveguides of the waveguide devices 105-*g*. Additionally or alternatively, the waveguide devices 105-*g* may be used to transmit a combined signal (e.g., linearly polarized signal) by excitation of two component signals in the divided waveguides having an appropriate phase offset.

Similarly, when a signal wave is received by antenna 710, the waveguide devices 105-*g* direct the energy of the received signal with a particular basis polarization to the corresponding divided waveguides. In some examples the satellite antenna may receive a combined signal (e.g., linearly polarized signal) and separate the combined signal into two component signals in the divided waveguides, which may be phase adjusted and processed to recover the combined signal. The antenna 710 may be used for receiving communication signals from a satellite, transmitting communication signals to the satellite, or bi-directional communication with the satellite (transmitting and receiving communication signals).

In some examples, the antenna 710 may transmit energy using a first polarization and receive energy of a second (e.g., orthogonal) polarization concurrently. In such an example, the waveguide devices 105-*g* may be used to transmit a first signal from antenna 710 having a first polarization (e.g., first linear polarization, LHCP, etc.) by exciting the appropriate divided waveguide(s) of the waveguide devices 105-*g*. Concurrently, the satellite antenna can receive a signal having a second polarization (e.g., second linear polarization, RHCP, etc.), where the second polarization is orthogonal to the first polarization. The waveguide devices 105-*g* can direct the energy of the received signal to the corresponding divided waveguide(s) for processing in a receiver to recover and demodulate the received signal.

In various examples the antenna assembly 700 can be used to receive and/or transmit single-band, dual-band, and/or multi-band signals. For instance, in some examples signals received and/or transmitted by the antenna assembly 700 may be characterized by multiple carrier frequencies in a frequency range of 17.5 to 31 GHz. In such examples, the performance of the waveguide device 105-*g* can be improved by including various sidewall features as described above.

In particular, a waveguide device 105-*g* may include one or more sidewall features 155 such as recess(es) and/or protrusion(s). Various parameters of each sidewall feature 155 (e.g., number, location, shape, size, spacing, etc.) may be determined according to a particular design implementation. Each sidewall feature adds degrees of freedom to the design of a waveguide device, which may help with performance optimization and may increase the achievable performance. For example, the addition of one or more sidewall features may allow designs to increase bandwidth margins, which may improve robustness to dimensional variations that may result from various manufacturing processes. This may be beneficial, for example, in relatively high volume applications (e.g., where molding or casting may be employed) to achieve increased yields. Furthermore, an increased bandwidth margin may, for instance, improve the ability to design, manufacture, and/or operate a septum polarizer configured to convert the polarization of signals at more than one carrier signal frequency.

Figure 8:
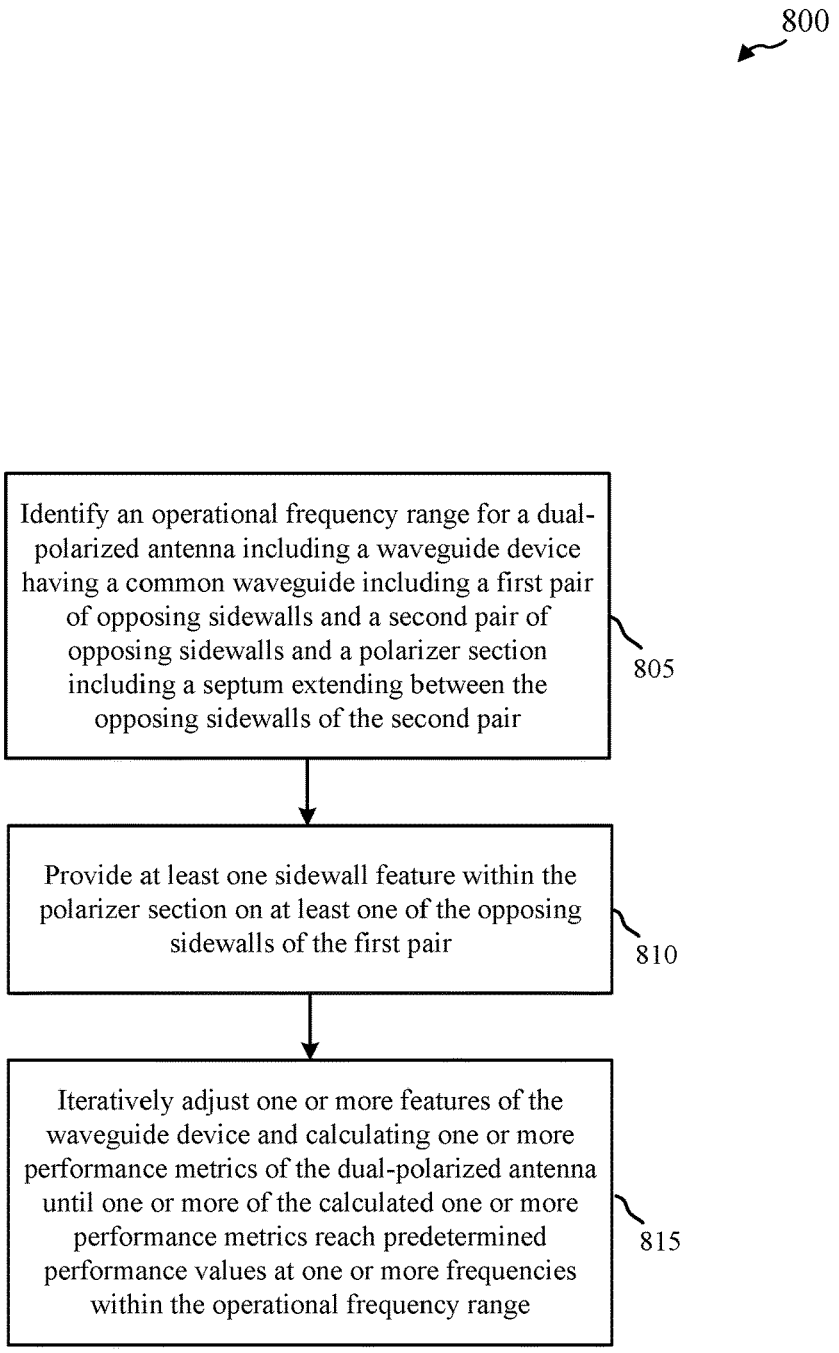
FIG. 8 shows a method for designing a waveguide device having at least one sidewall feature in accordance with various aspects of the present disclosure.

FIG. 8 shows a method 800 for designing a waveguide device having at least one sidewall feature in accordance with various aspects of the present disclosure. The method 800 may be used, for example, to design a waveguide device for a dual-polarized antenna with a desired operational frequency range. The method 800 may be used to iteratively select the number, shape(s), dimensions, and relative positions of one or more sidewall features 155 for the waveguide devices 105 of FIGS. 1A, 1B, 2, 3, 4 or 5.

Method 800 may begin at step 805 where an operational frequency range may be identified for a dual-polarized antenna including a waveguide device having a common waveguide including a first set of opposing sidewalls and a second set of opposing sidewalls and a polarizer section including a septum extending between the opposing sidewalls of the second set. The operational frequency range may include multiple discontinuous frequency segments (e.g., dual band operation, etc.).

At block 810, at least one sidewall feature may be provided within the polarizer section on at least one of the opposing sidewalls of the first set of opposing sidewalls. The at least one sidewall feature may include aspects of the sidewall features discussed above with reference to FIGS. 1A, 1B, and 2-5.

At block 815, one or more features of the waveguide device may be iteratively adjusted and one or more performance metrics of the dual-polarized antenna may be calculated until one or more of the calculated one or more performance metrics reach predetermined performance values at one or more frequencies within the operational frequency range. For example, the one or more performance metrics may be calculated at each of a plurality of frequencies within the operational frequency range, and the one or more features of the waveguide device may be adjusted until the one or more of the calculated one or more performance metrics reach the predetermined performance values at each of the plurality of frequencies.

The performance metrics may include, for example, axial ratio, port isolation, return loss, or higher order mode suppression. The one or more features of the waveguide device may include the cross-section of the common waveguide or the number, shape(s), dimensions, or relative positions of one or more sidewall features.

The detailed description set forth above in connection with the appended drawings describes exemplary embodiments and does not represent the only embodiments that may be implemented or that are within the scope of the claims. The term "example" used throughout this description means "serving as an example, instance, or illustration," and not "preferred" or "advantageous over other embodiments." The detailed description includes specific details for the purpose of providing an understanding of the described techniques. These techniques, however, may be practiced without these specific details. In some instances, well-known structures and devices are shown in block diagram form in order to avoid obscuring the concepts of the described embodiments.

Information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The functions described herein may be implemented in various ways, with different materials, features, shapes, sizes, or the like. Other examples and implementations are within the scope of the disclosure and appended claims. Features implementing functions may also be physically located at various positions, including being distributed such that portions of functions are implemented at different physical locations. Also, as used herein, including in the claims, "or" as used in a list of items (for example, a list of items prefaced by a phrase such as "at least one of" or "one or more of") indicates a disjunctive list such that, for example, a list of "at least one of A, B, or C" means A or B or C or AB or AC or BC or ABC (i.e., A and B and C).

As used in the description herein, the term "parallel" is not intended to suggest a limitation to precise geometric parallelism. For instance, the term "parallel" as used in the present disclosure is intended to include typical deviations from geometric parallelism relating to such considerations as, for example, manufacturing and assembly tolerances. Furthermore, certain manufacturing process such as molding or casting may require positive or negative drafting, edge chamfers and/or fillets, or other features to facilitate any of the manufacturing, assembly, or operation of various components, in which case certain surfaces may not be geometrically parallel, but may be parallel in the context of the present disclosure.

Similarly, as used in the description herein, the terms "orthogonal" and "perpendicular", when used to describe geometric relationships, are not intended to suggest a limitation to precise geometric perpendicularity. For instance, the terms "orthogonal" and "perpendicular" as used in the present disclosure are intended to include typical deviations from geometric perpendicularity relating to such considerations as, for example, manufacturing and assembly tolerances. Furthermore, certain manufacturing process such as molding or casting may require positive or negative drafting, edge chamfers and/or fillets, or other features to facilitate any of the manufacturing, assembly, or operation of various components, in which case certain surfaces may not be geometrically perpendicular, but may be perpendicular in the context of the present disclosure.

As used in the description herein, the term "orthogonal," when used to describe electromagnetic polarizations, are meant to distinguish two polarizations that are separable. For instance, two linear polarizations that have unit vector directions that are separated by 90 degrees can be considered orthogonal. For circular polarizations, two polarizations are considered orthogonal when they share a direction of propagation, but are rotating in opposite directions.

The previous description of the disclosure is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not to be limited to the examples and designs described herein but is to be accorded the widest scope consistent with the principles and novel features disclosed herein.

What is claimed is:

1. A waveguide device, comprising:

a common waveguide section;

a divided waveguide section having a first divided waveguide associated with a first basis polarization and a second divided waveguide associated with a second basis polarization;

a polarizer section coupled between the common waveguide section and the divided waveguide section, the polarizer section comprising a central axis in a direction between the common waveguide section and the divided waveguide section, and a septum forming a boundary between the first and second divided waveguides; and at least one sidewall feature on at least one sidewall of the polarizer section, wherein the at least one sidewall feature is coincident with the septum along the central axis.

2. The waveguide device of claim 1, wherein the at least one sidewall feature comprises:

a first sidewall feature; and a second sidewall feature situated opposite the first sidewall feature relative to the central axis.

3. The waveguide device of claim 2, wherein the first sidewall feature and the second sidewall feature are aligned with one another.

4. The waveguide device of claim 1, wherein the at least one sidewall feature comprises:

a first sidewall feature; and a second sidewall feature situated on a same side of the central axis as the first sidewall feature.

5. The waveguide device of claim 1, wherein the at least one sidewall feature comprises at least two sidewall features of different sizes.

6. The waveguide device of claim 1, wherein the septum comprises a stepped septum comprising a plurality of stepped surfaces arranged in the direction of the central axis.

7. The waveguide device of claim 1, wherein a cross-section of the at least one sidewall feature is rectangular, rounded, or triangular.

8. The waveguide device of claim 1, wherein the at least one sidewall feature comprises a recess in the at least one sidewall of the polarizer section.

9. The waveguide device of claim 8, wherein the recess comprises a channel extending in a direction orthogonal to the central axis.

10. The waveguide device of claim 1, wherein the at least one sidewall feature comprises a protrusion on the at least one sidewall of the polarizer section.

11. The waveguide device of claim 10, wherein the protrusion comprises a ridge extending in a direction orthogonal to the central axis.

12. The waveguide device of claim 1, wherein the at least one sidewall feature comprises:

at least one recess into the at least one sidewall; and at least one protrusion from the at least one sidewall.

13. The waveguide device of claim 1, wherein:

the at least one sidewall feature has a depth in a direction orthogonal to the central axis, and a width in a direction of the central axis; and a cross-sectional dimension of the polarizer section is at least five times greater than at least one of the depth or the width of the at least one sidewall feature.

14. The waveguide device of claim 13, wherein the cross-sectional dimension of the polarizer section is at least ten times greater than the at least one of the depth or the width of the at least one sidewall feature.

15. The waveguide device of claim 1, wherein the at least one sidewall feature comprises a material that is different from a material of the at least one sidewall of the of the polarizer section.

16. The waveguide device of claim 1, wherein a cross-sectional shape of the common waveguide section is rectangular, square, trapezoidal, polygonal, circular, oval-shaped, or elliptical.

17. A waveguide device, comprising:

a plurality of polarizers, each polarizer having a common waveguide section, a divided waveguide section with a first divided waveguide associated with a first basis polarization and a second divided waveguide associated with a second basis polarization, and a polarizer section coupled between the common waveguide section of the polarizer and the first and second divided waveguides, wherein the polarizer section of each polarizer from the plurality of polarizers comprises:

a central axis in a direction between the common waveguide section and the divided waveguide section, and a septum forming a boundary between the first and second divided waveguides, and at least one sidewall feature on at least one sidewall of the polarizer section, wherein the at least one sidewall feature is coincident with the septum along the central axis.

18. The waveguide device of claim 17, further comprising:

a plurality of antenna elements coupled with common waveguide sections of respective polarizers from the plurality of polarizers.

19. The waveguide device of claim 18, wherein the plurality of polarizers are configured in any of a grid array, a transversely staggered array, an axially staggered array, a rectangular array, a square array, a round array, or a circular array.

20. The waveguide device of claim 17, further comprising:

a first waveguide feed network coupling the first divided waveguides of the plurality of polarizers to a first common port; and a second waveguide feed network coupling the second divided waveguides of the plurality of polarizers to a second common port.

21. The waveguide device of claim 17, wherein the at least one sidewall feature of each polarizer from the plurality of polarizers comprises:

a first sidewall feature; and a second sidewall feature situated opposite the first sidewall feature relative to the central axis.

22. The waveguide device of claim 21, wherein the first sidewall feature and the second sidewall feature are aligned with one another.

23. The waveguide device of claim 17, wherein the at least one sidewall feature of each polarizer from the plurality of polarizers comprises:

a first sidewall feature; and a second sidewall feature situated on a same side of the central axis as the first sidewall feature.

24. The waveguide device of claim 17, wherein the at least one sidewall feature of each polarizer from the plurality of polarizers comprises at least two sidewall features of different sizes.

25. The waveguide device of claim 17, wherein the septum of each polarizer from the plurality of polarizers comprises a stepped septum comprising a plurality of stepped surfaces arranged in the direction of the central axis.

26. The waveguide device of claim 17, wherein a cross-section of the at least one sidewall feature of each polarizer from the plurality of polarizers is rectangular, rounded, or triangular.

27. The waveguide device of claim 17, wherein the at least one sidewall feature of each polarizer from the plurality of polarizers comprises a recess in the at least one sidewall of the polarizer section.

28. The waveguide device of claim 27, wherein the recess comprises a channel extending in a direction orthogonal to the central axis.

29. The waveguide device of claim 17, wherein the at least one sidewall feature of each polarizer from the plurality of polarizers comprises a protrusion on the at least one sidewall of the polarizer section.

30. The waveguide device of claim 29, wherein the protrusion comprises a ridge extending in a direction orthogonal to the central axis.

31. The waveguide device of claim 17, wherein the at least one sidewall feature of each polarizer from the plurality of polarizers comprises:

at least one recess into the at least one sidewall; and at least one protrusion from the at least one sidewall.

32. The waveguide device of claim 17, wherein:

the at least one sidewall feature of each polarizer from the plurality of polarizers has a depth in a direction orthogonal to the central axis, and a width in a direction of the central axis; and a cross-sectional dimension of the polarizer section of each polarizer from the plurality of polarizers is at least five times greater than at least one of the depth or the width of the at least one sidewall feature.

33. The waveguide device of claim 32, wherein the cross-sectional dimension of the polarizer section of each polarizer from the plurality of polarizers is at least ten times greater than the at least one of the depth or the width of the at least one sidewall feature.

34. The waveguide device of claim 17, wherein the at least one sidewall feature of each polarizer from the plurality of polarizers comprises a material that is different from a material of the at least one sidewall of the of the polarizer section.

35. The waveguide device of claim 17, wherein a cross-sectional shape of the common waveguide section of each polarizer from the plurality of polarizers is rectangular, square, trapezoidal, polygonal, circular, oval-shaped, or elliptical.

* * * * *